US009396619B2

(12) United States Patent
Cho et al.

(10) Patent No.: US 9,396,619 B2
(45) Date of Patent: Jul. 19, 2016

(54) APPARATUS FOR RECEIVING CASH AND CHECKS

(71) Applicant: Nautilus Hyosung Inc., Seoul (KR)
(72) Inventors: Ji Youn Cho, Seoul (KR); Jin Hwan Cha, Anyang-si (KR); Hyun Soo Jang, Suwon-si (KR); Seok Won Kim, Seoul (KR)
(73) Assignee: NAUTILUS HYOSUNG INC., Seoul (KR)

( * ) Notice: Subject to any disclaimer, the term of this patent is extended or adjusted under 35 U.S.C. 154(b) by 201 days.
(21) Appl. No.: 14/140,937
(22) Filed: Dec. 26, 2013
(65) Prior Publication Data

US 2015/0161854 A1 Jun. 11, 2015

(30) Foreign Application Priority Data

Dec. 6, 2013 (KR) ..... 10-2013-0151265
Dec. 6, 2013 (KR) ..... 10-2013-0151266

(51) Int. Cl.
*B65H 5/00* (2006.01)
*G07F 19/00* (2006.01)
(Continued)

(52) U.S. Cl.
CPC ..... *G07F 19/202* (2013.01); *B65H 1/14* (2013.01); *B65H 3/047* (2013.01); *B65H 3/5261* (2013.01);
(Continued)

(58) Field of Classification Search
CPC ..... B65G 15/14; G07D 11/0081; G07D 11/0084; G07D 11/0087; G07D 11/0021; G07D 11/0024; G07D 2207/00; G07D 2211/00; G07D 7/00; B65H 3/047; B65H 3/5253; B65H 5/023; B65H 3/5269; B65H 2301/44316; B65H 2301/4473; B65H 2301/44732; B65H 2404/261
USPC ..... 198/626.3, 626.4, 626.6; 414/796.5, 414/796.6, 797.2, 796.7, 795.7; 194/206, 194/207; 209/534; 902/8–18; 271/10.02, 271/10.03, 10.06, 10.07, 34, 35, 275, 3.01, 271/3.02, 3.14, 4.05, 4.06
See application file for complete search history.

(56) References Cited

U.S. PATENT DOCUMENTS 4,475,732 A * 10/1984 Clausing et al. ..... 271/34
4,978,114 A * 12/1990 Holbrook ..... 271/35
(Continued)

FOREIGN PATENT DOCUMENTS

JP 63-154538 * 6/1988
JP 1-247347 * 10/1989
(Continued)

OTHER PUBLICATIONS

English abstract of JP1-247347, Oct. 1989.*
English abstract of JP63-154538, Jun. 1988.*

*Primary Examiner* — Thomas Morrison
(74) *Attorney, Agent, or Firm* — Fenwick & West LLP

(57) ABSTRACT

Disclosed herein is an apparatus for receiving cash and checks. The apparatus includes a bundle transfer unit, a semi-separation unit and a sheet-by-sheet separation. The bundle transfer unit transfers a bill bundle input into the apparatus. The bundle transfer unit is provided above and below the bill bundle and extends along a path for transferring the bill bundle. The semi-separation unit is installed behind a rear end of the bundle transfer unit. The semi-separation unit limits the number of bills to be transferred in such a way that only a preset number of bills separated from the bill bundle is allowed to pass through the semi-separation unit. The sheet-by-sheet separation unit is installed behind a rear end of the semi-separation unit. The sheet-by-sheet separation unit separates bills transferred from the semi-separation unit from each other sheet-by-sheet.

18 Claims, 12 Drawing Sheets

(51) Int. Cl.

| | |
|---|---|
| ***B65H 1/14*** | (2006.01) |
| ***B65H 3/04*** | (2006.01) |
| ***B65H 3/52*** | (2006.01) |
| ***B65H 7/04*** | (2006.01) |

(52) U.S. Cl.

CPC ..... *B65H 5/006* (2013.01); *B65H 7/04* (2013.01); *G07F 19/203* (2013.01); *B65H 2301/4228* (2013.01); *B65H 2301/42262* (2013.01); *B65H 2404/2614* (2013.01); *B65H 2511/515* (2013.01); *B65H 2513/40* (2013.01); *B65H 2701/1311* (2013.01); *B65H 2701/1912* (2013.01)

(56) References Cited

U.S. PATENT DOCUMENTS

| | | | | |
|---|---|---|---|---|
| 7,849,992 | B2 * | 12/2010 | Seo et al. ..... | 194/206 |
| 8,376,144 | B2 * | 2/2013 | Yokokawa et al. ..... | 209/534 |
| 2013/0049282 | A1 | 2/2013 | Shin et al. | |

FOREIGN PATENT DOCUMENTS

| | | | |
|---|---|---|---|
| JP | 2010-165164 | A | 7/2010 |
| KR | 10-2005-0038233 | A | 4/2005 |
| KR | 10-2008-0017733 | | 2/2008 |
| KR | 10-1183980 | | 9/2012 |

* cited by examiner

APPARATUS FOR RECEIVING CASH AND CHECKS

CROSS-REFERENCE TO RELATED APPLICATIONS

This application claims the benefit of Korean Patent Application No. 10-2013-0151265, filed on Dec. 6, 2013 and Korean Patent Application No. 10-2013-0151266, filed on Dec. 6, 2013, which are incorporated by reference herein in their entirety.

FIELD OF THE INVENTION

The present invention relates to apparatuses for receiving cash and checks.

BACKGROUND OF THE INVENTION

Generally, ATMs (automatic teller machines) are electronic telecommunication devices which enable users to use financial services such as deposit or withdrawal of cash and checks using cards or bankbooks regardless of time and place without the need for a cashier or bank teller.

Recently, not only in banking facilities such as banks, but also in convenience stores, department stores and other public places, use of ATMs is increasing.

According to deposit and withdrawal availability, ATMs are classified into a withdrawal machine, a deposit machine and a deposit and withdrawal machine. Nowadays, ATMs are used in various ways, for example, not only for deposit and withdrawal of cash but also for deposit and withdrawal of checks, update of bankbooks, paying by giro, ticketing, etc.

In conventional ATMs, generally, an apparatus for receiving and dispensing of checks and an apparatus for receiving and dispensing of cash are separately provided. These apparatuses are separately installed in housings of the ATMs.

Cash can be deposited or withdrawn by means of the cash receiving and dispensing apparatus, and checks can be deposited or withdrawn by means of the check receiving and dispensing apparatus. As such, in the case where the cash receiving and dispensing apparatus and the check receiving and dispensing apparatus are separately provided, the size of the entirety of the ATMs is increased, and it is difficult to enhance efficiency in use of space.

Meanwhile, unlike cash, different kinds of characters are printed on checks with a special magnetic ink. A check deposit apparatus for processing checks uses a MICR (magnetic ink character reader) to read characters, such as serial number, printed on check before a check deposit process.

Typically, the size of checks is set to a fixed size. However, in some countries, the size of check may be different. Furthermore, for example, personal checks issued by individuals and business checks issued by companies may have different sizes. In this case, different kinds of checks along with cash cannot be deposited or withdrawn in a bundle form, thus inconveniencing users. Even if it is possible to input a bundle of cash and checks having different sizes into an ATM, because the input cash and checks are typically not in an aligned state, it is difficult for the ATM to recognize each sheet of cash and check.

Meanwhile, in the case where cash and bills (hereinafter, they will be used along with the term "bill") are received or dispensed in a bundle form, a problem in which bills are not correctly separated from each other during a process of transferring all of the bills at once may be caused. Thereby, deposit or withdrawal of the bills may be delayed, or it may be impossible to deposit or withdraw the bills.

Therefore, a cash and check receiving apparatus, which enables cash and checks to be deposited in a bundle (bunch) form at the same time so that the entire size of the ATM can be reduced, and which can enhance the performance of separating bills from each other sheet-by-sheet, is required.

SUMMARY OF THE INVENTION

It is, therefore, an object of the present invention to provide an apparatus for receiving cash and checks which is configured such that cash and checks can be received in a bundle form at the same time into a single apparatus, and even if a lot of bills are inserted into the apparatus, the operation of separating bills can be reliably conducted.

Another object of the present invention is to provide an apparatus for receiving cash and checks in which cash and checks having different sizes can be aligned with each other, thus making it easy and reliable to recognize each of the cash and checks.

In accordance with a preferred embodiment of the present invention, there is provided an apparatus for receiving cash and checks that is able to receive and process a bill bundle input thereinto, the bill bundle including at least one of cash and checks, the apparatus including: a bundle transfer unit for transferring the bill bundle input into the apparatus, the bundle transfer unit being provided above and below the bill bundle and extending along a path for transferring the bill bundle; a semi-separation unit installed behind a rear end of the bundle transfer unit, the semi-separation unit limiting the number of bills to be transferred in such a way that only a preset number of bills separated from the bill bundle is allowed to pass through the semi-separation unit; and a sheet-by-sheet separation unit installed behind a rear end of the semi-separation unit, the sheet-by-sheet separation unit separating bills transferred from the semi-separation unit from each other sheet-by-sheet.

The bundle transfer unit may include: a first bundle transfer part disposed above the bill bundle input into the apparatus, the first bundle transfer part coming into an upper surface of the bill bundle; and a second bundle transfer part disposed below the bill bundle input into the apparatus, the second bundle transfer part coming into a lower surface of the bill bundle.

The first bundle transfer part may extend rearwards longer than the second bundle transfer part.

The first bundle transfer part may include a guide with a space defined between the guide and the semi-separation unit, the space being set such that only the preset number of bills can pass through the space.

Before the bill bundle input into the apparatus reaches a preset reference position, both the first bundle transfer part and the second bundle transfer part may be operated such that the bill bundle is moved towards the semi-separation unit. When the bill bundle reaches the preset reference position, the first bundle transfer part may be continuously operated, and the second bundle transfer part may be interrupted.

Furthermore, a bundle sensor may be provided at the reference position so as to sense whether the bill bundle reaches the reference position.

The second bundle transfer part may include a lift means for moving the second bundle transfer part in a vertical direction so that a space corresponding to a thickness of the bill bundle is formed between the first bundle transfer part and the second bundle transfer part.

The lift means may include: a frame on which bundle transfer rollers and a belt are installed; a base provided below the frame at a position spaced apart from the frame by a predetermined distance; and a lift for lifting the frame from the base.

In addition, an elastic member may be installed between the frame and the base, the elastic member applying external force to the frame upwards.

The semi-separation unit may include: a semi-separation roller provided such that a space is defined between the semi-separation roller and a lower surface the bundle transfer unit, the space allowing the preset number of bills to pass therethrough; and a bill press provided so as to be movable upwards or downwards, with the semi-separation roller provided at a predetermined position on an upper end of the bill press.

The semi-separation roller may include a one-way roller configured such that when bills are transferred in a bill receiving direction, the one-way roller does not rotate, and only when the bills are moved in a direction opposite to the bill receiving direction be the one-way roller rotated.

The sheet-by-sheet separation unit may include: main rollers rotatably provided in respective opposite ends of the sheet-by-sheet separation unit; a belt connecting the main rollers to each other to form an endless track structure; and a tension roller disposed between the main rollers, the tension roller applying tensile force to the belt so that only a single bill is able to pass between the belt and the tension roller.

The tension roller may be stationary without rotating.

The tension roller may apply pressure to the belt so that a lower portion of the belt forms a curved shape.

The apparatus may further include an alignment unit applying external force to the bill bundle that has reached the preset reference position by the bundle transfer unit, whereby a first side of the bill bundle is aligned with respect to a vertical direction.

The alignment unit may include: a vertical member placed upwards adjacent to the first side of the bill bundle; and a sheet roller unit provided above the bill bundle so as to be rotatable, the sheet roller unit rotating and applying external force to the bill bundle to move at least one bill of the bill bundle in a lateral direction, whereby the first side of the bill bundle comes into close contact with the vertical member.

The sheet roller unit may strike a second side of the bill bundle such that the first side of the bill bundle comes into close contact with the vertical member.

The sheet roller unit may make contact with an upper portion of the bill bundle and move the bills in the lateral direction using friction force such that the first side of the bill bundle comes into close contact with the vertical member.

The sheet roller unit may include: a roller body provided so as to be rotatable around a rotating shaft; and elastic sheets arranged in a circumferential direction on a predetermined partial section of an outer circumferential surface of the roller body, each of the elastic sheets radially protruding a predetermined length from the outer circumferential surface of the roller body so that when the roller body rotates, the elastic sheets strike the bill bundle.

The elastic sheets may be spaced apart from each other at regular intervals and provided on a partial section of the roller body that is less than a half of the outer circumferential surface of the roller body.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

This invention may, however, be embodied in many different forms, and should not be construed as limited to the embodiments set forth herein. Rather, all changes that fall within the bounds of the present invention, or the equivalence of the bounds are therefore intended to be embraced by the present invention.

It will be understood that, although the terms first, second, etc. may be used herein to describe various elements, these elements should not be limited by these terms. These terms are only used to distinguish one element, from another element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present.

The terminology used herein is for the purpose of describing particular embodiments only and is not intended to be limiting. As used herein, the singular forms "a," "an" and "the" are intended to include the plural forms as well, unless the context clearly indicates otherwise.

It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Hereinafter, a first embodiment of the present invention will be described in detail with reference to the accompanying drawings.

Figure 1:
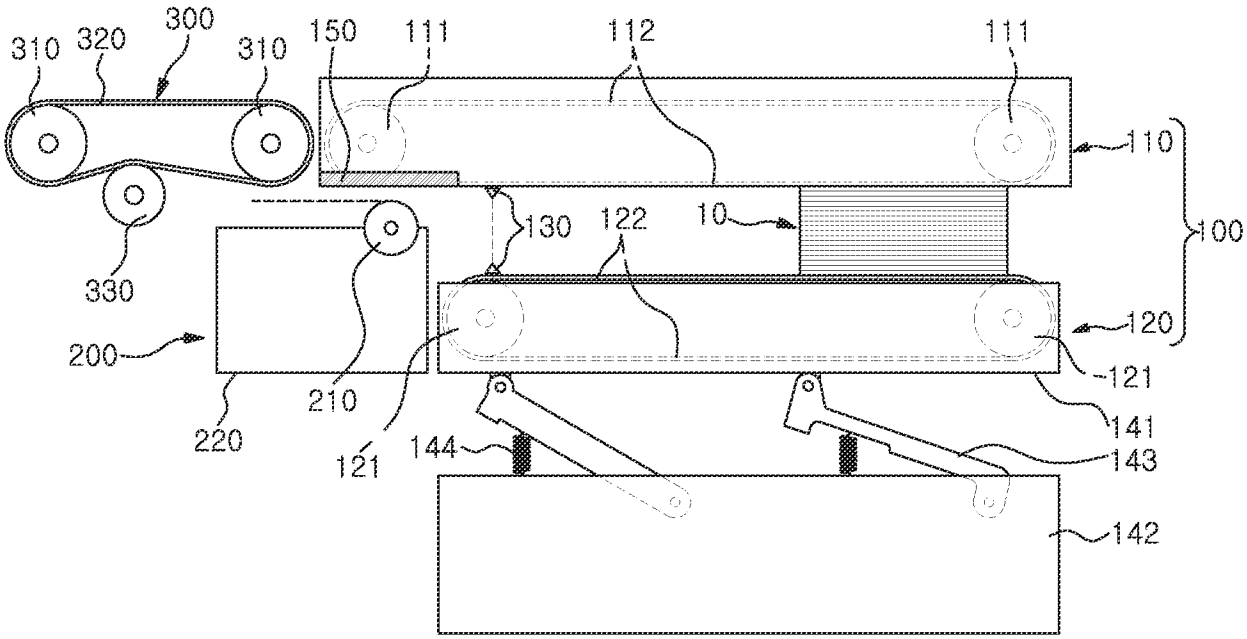
FIG. 1 is a view showing the construction of an apparatus for receiving cash and checks in accordance with a first embodiment of the present invention.

FIG. 1 is a view showing the construction of an apparatus for receiving cash and checks in accordance with a first embodiment of the present invention.

Referring to FIG. 1, the first embodiment of the present invention relates to the cash and check receiving apparatus which receives and processes a bill bundle 10 which includes at least one of cash and checks and is supplied into the apparatus. The cash and check receiving apparatus includes a bundle transfer unit 100, a semi-separation unit 200 and a sheet-by-sheet separation unit 300. A second embodiment of the present invention further includes an alignment unit 160 based on the construction of the first embodiment.

Here, the words the first embodiment of the present invention includes the bundle transfer unit 100, the semi-separation unit 200 and the sheet-by-sheet separation unit 300 mean basically including these elements rather than meaning consisting of only these elements. That is, the first embodiment may include other elements embodied, for example, by known techniques which are used in the typical ATMs. However, detailed explanation of such known techniques will be omitted because it may make the gist of the present invention unclear. Furthermore, the first embodiment in accordance with the present invention can be applied not only to the cash and check receiving apparatus but also to a cash and check dispensing apparatus.

As shown in FIG. 1, the bundle transfer unit 100 is provided above and below the bill bundle 10 supplied into the apparatus and extends along a transfer path for the bill bundle 10. The bundle transfer unit 100 moves the bill bundle 10 such that the bill bundle 10 is transferred along the transfer path.

The term the bill bundle 10 means bills which are provided in a bundle or bunch shape. Bills are money made of paper and are able to include cash and checks. In this embodiment, the bill bundle 10 refers to a bundle which includes only cash or checks or a bundle in which cash and checks are mixed.

The bundle transfer unit 100 includes a first bundle transfer part 110 which is disposed above the bill bundle 10 supplied into the bundle transfer unit 100 and comes into contact with an upper surface of the bill bundle 10, and a second bundle transfer part 120 which is disposed below the bill bundle 10 and comes into contact with a lower surface of the bill bundle 10.

The first bundle transfer part 110 and the second bundle transfer part 120 grasp the bill bundle 10 in such a way that the first and second bundle transfer parts 110 and 120 respectively come into close contact with the upper and lower surfaces of the bill bundle 10, and then move the bill bundle 10 by a predetermined distance along the transfer path for receiving.

Figure 2:
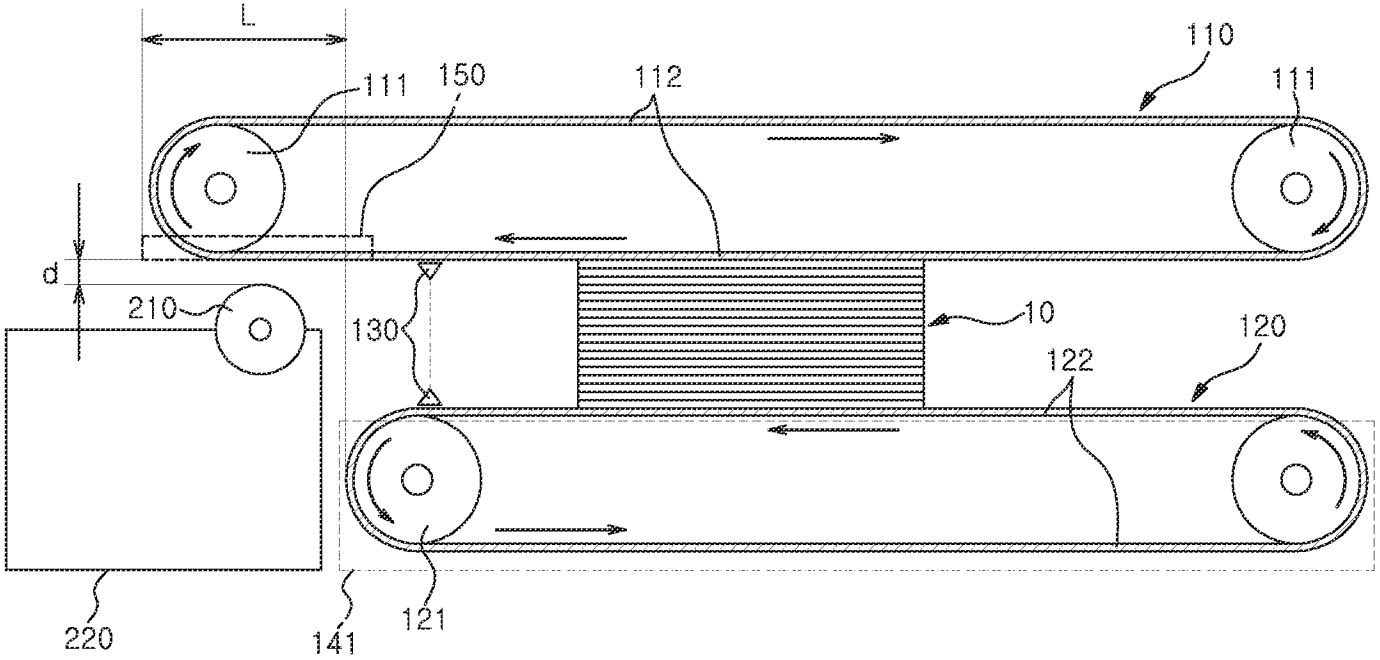
FIGS. 2 through 4 are views illustrating the construction and operation of a bundle transfer unit and a semi-separation unit of the cash and check receiving apparatus in accordance with the first embodiment of the present invention.
Figure 3:
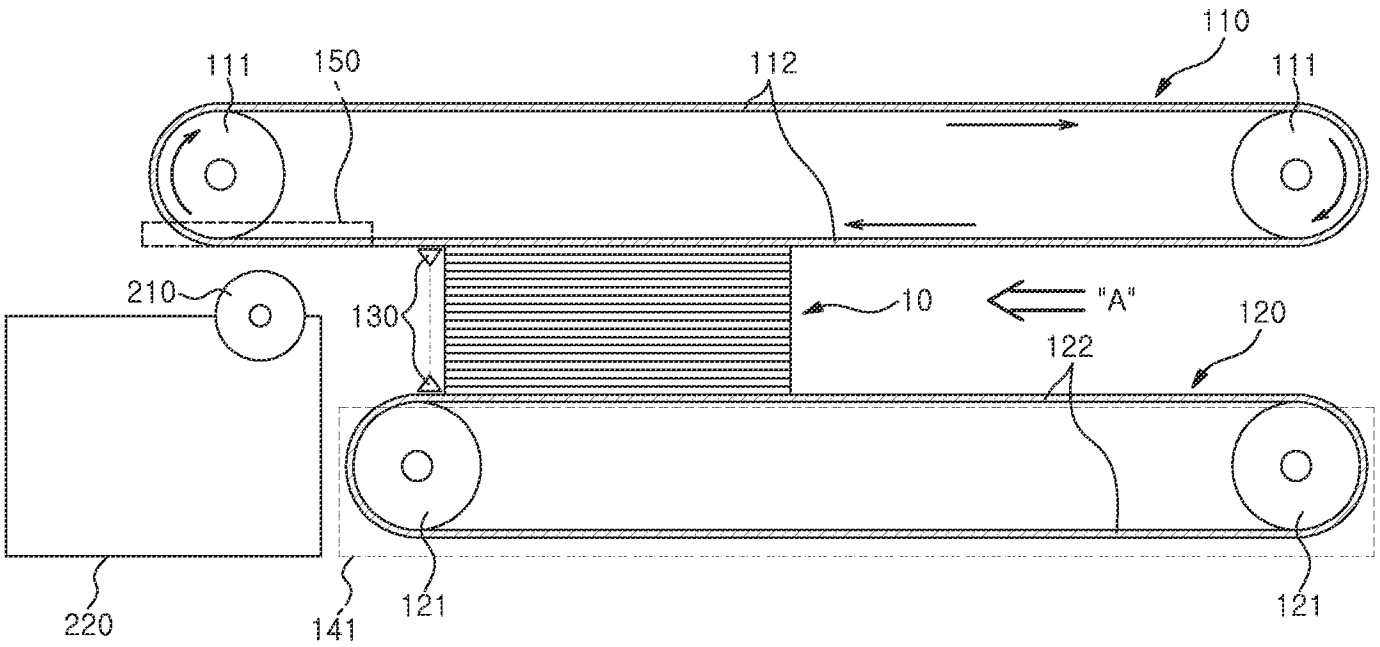

As shown in FIGS. 2 and 3, the first bundle transfer part 110 includes first bundle transfer rollers 111 which are provided so as to be reversely rotatable and are disposed at opposite ends of the transfer path at positions spaced apart from each other, and a first belt 112 which connects the first bundle transfer rollers 111 to each other so as to form an endless track structure.

Therefore, when the first bundle transfer rollers 111 rotate in one direction, the first belt 112 receives rotating force and rotates in a normal direction to receive the bill bundle 10 or in a reverse direction opposite to the normal direction in which the bill bundle 10 is received.

The second bundle transfer part 120 includes second bundle transfer rollers 121 which are provided so as to be reversely rotatable and are disposed at opposite ends of the transfer path at positions spaced apart from each other, and a second belt 122 which connects the second bundle transfer rollers 121 to each other so as to form an endless track structure.

A lower portion of the first belt 112 comes into contact with the upper surface of the bill bundle 10, and an upper portion of the second belt 122 comes into contact with the lower surface of the bill bundle 10. The lower portion of the first belt 112 and the upper portion of the second belt 122 must move in the same direction. For this, the first bundle transfer rollers 111 rotate in a direction opposite to a direction in which the second bundle transfer rollers 121 rotate.

For example, if the bill bundle 10 must be moved in the bill receiving transfer path, the first bundle transfer roller 111 rotates in a clockwise direction based on the drawings, and the second bundle transfer roller 121 rotates in a counterclockwise direction so that the bill bundle 10 is moved towards the semi-separation unit 200 (in the bill receiving direction).

In this embodiment, the first bundle transfer part 110 further extends rearwards by a predetermined length L from the second bundle transfer part 120

The reason why the first bundle transfer part 110 further extends rearwards from the second bundle transfer part 120 is to operate the bundle transfer unit 100 in such a way that when the bill bundle 10 supplied thereinto reaches a preset reference position, the second bundle transfer part 120 is interrupted and only the first bundle transfer part 110 is continuously operated so that only bills that are disposed in an upper portion of the bill bundle 10 can be moved rearwards by the first bundle transfer part 110.

In other words, as shown in FIG. 2, before the bill bundle 10 reaches the preset reference position, both the first bundle transfer part 110 and the second bundle transfer part 120 are operated such that the bill bundle 10 is moved towards the semi-separation unit 200 (in the bill receiving direction)

As shown in FIG. 3, when the bill bundle 10 that has been moved by the first bundle transfer part 110 and the second bundle transfer part 120 reaches the preset reference position, the arrival of the bill bundle 10 is sensed, and the first bundle transfer part 110 is continuously operated in the same direction but the second bundle transfer part 120 is stopped.

To sense whether the bill bundle 10 that is moved by the first bundle transfer part 110 and the second bundle transfer part 120 reaches the reference position, a bundle sensor 130 for sensing the bill bundle 10 is installed at the reference position.

The bundle sensor 130 is disposed at a position at which it neither impedes the movement of the bill bundle 10 along the transfer path nor interferes with peripheral structures. Depending on circumstances, the bundle sensor 130 can be embodied by any one among an ultrasonic sensor, a laser sensor or an emitting/receiving sensor to sense whether the bill bundle 10 reaches the reference position. Apart from the sensors listed above, as needed, other sensors may be selectively used.

It is preferable that the preset reference position, that is, the position at which the bundle sensor 130 is disposed, be a point of a rear end of the second bundle transfer part 120.

Figure 4:
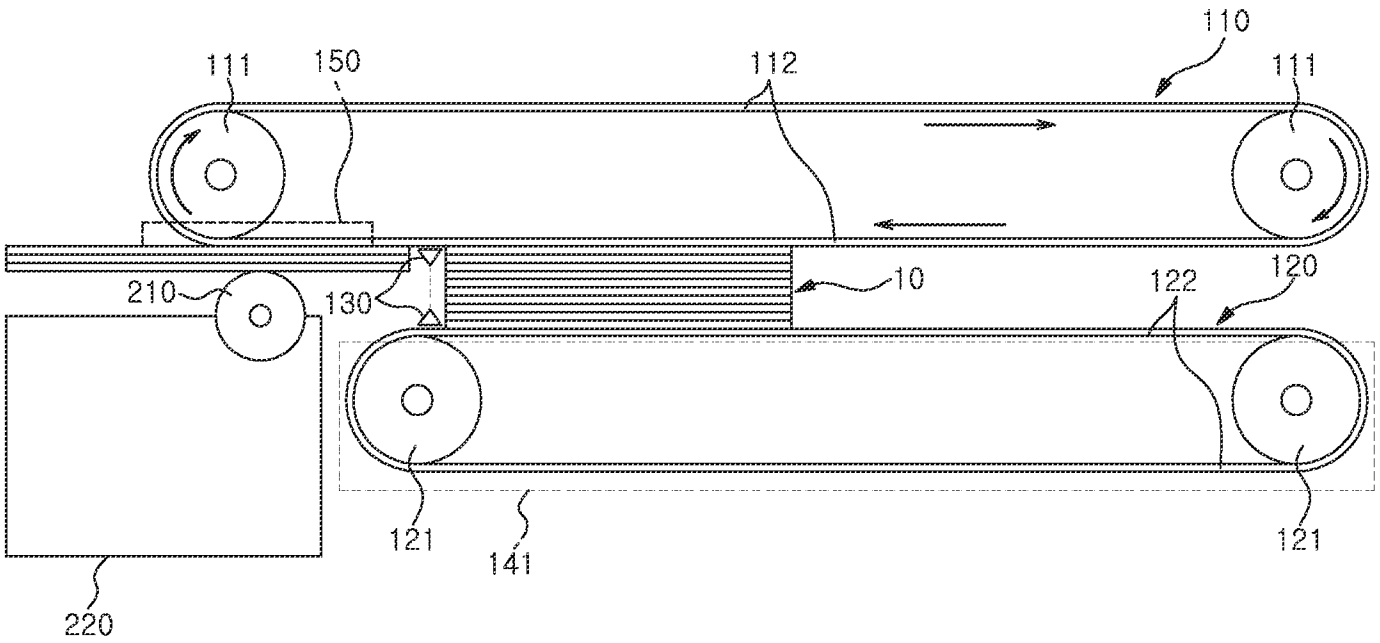

Therefore, when the bundle sensor 130 senses the bill bundle 10 that is moving along the transfer path, the operation of the second bundle transfer part 120 is interrupted. While the operation of the second bundle transfer part 120 is interrupted, only the first bundle transfer part 110 is continuously operated in the same direction as before. Then, as shown in FIG. 4, rather than the entirety of the bill bundle 10, only an upper portion of the bill bundle 10 that makes contact with the first belt 112 is moved.

Here, although only the uppermost one bill of the bill bundle 10 makes contact with the first belt 112, because frictional force is applied between the bills piled to form a bundle shape, one or more bills are moved at the same time by the first belt 112 rather than the uppermost one bill.

For reference, in this embodiment, when the bundle sensor 130 senses the bill bundle 10 that reaches the reference position, a predetermined signal is output and is transmitted to a control unit. Then, the control unit interrupts the operation of the second bundle transfer part 120. Such control logic is widely known by those skilled in this art. Therefore, a separate explanation of such control logic and illustration of the construction thereof on the drawings will be omitted.

As shown in FIGS. 1 and 2, the second bundle transfer part 120 includes a lift means 140 which vertically moves the second bundle transfer part 120 to form space corresponding to the height (thickness) of the bill bundle 10 between the first and second bundle transfer parts 110 and the 120.

As such, as the second bundle transfer part 120 is moved upwards or downwards by the lift means 140, the distance between the first and second bundle transfer parts 110 and 120 can be adjusted. The distance between the first and second bundle transfer parts 110 and 120 must be adjusted depending on the thickness of the bill bundle 10 supplied into the bundle transfer unit 100.

Figure 5:
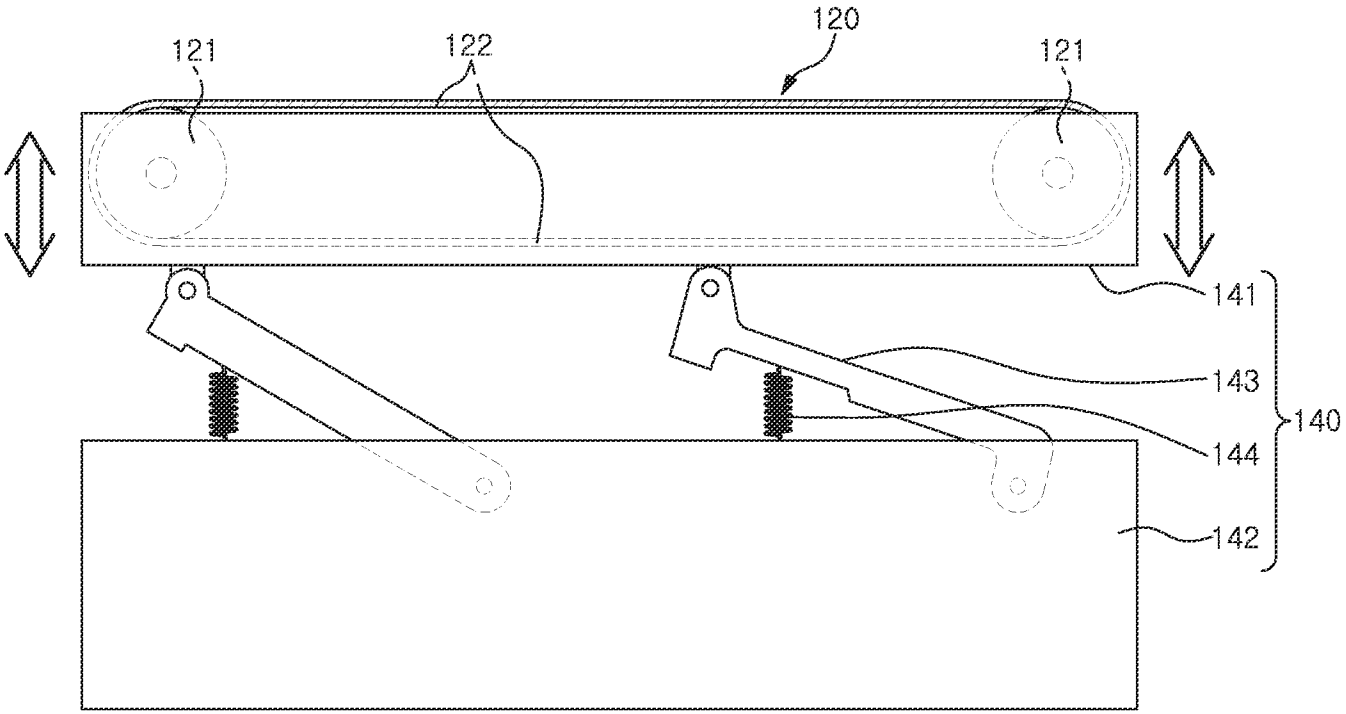
FIG. 5 is a view illustrating the construction of a second bundle transfer part of the cash and check receiving apparatus and a structure for lifting the second bundle transfer part in accordance with the first embodiment of the present invention.

As shown in FIG. 5, the lift means 140 includes a frame 141, a base 142 and a lift 143.

The second bundle transfer rollers 121 and the second belt 122 are installed on the frame 141. Thus, as the height of the frame 141 is adjusted, the second bundle transfer rollers 121 and the second belt 122 can also be adjusted in height, whereby the distance between the first bundle transfer part 110 and the second bundle transfer part 120 can be adjusted.

The base 142 is disposed below the frame 141 at a position spaced apart from the frame 141 by a predetermined distance. The lift 143 functions to moves the frame 141 from the base 142 upwards or downwards.

As shown in the drawings, the lift 143 may be embodied by a link structure provided between the frame 141 and the base 142. The lift 143 is not limited to this link structure. In other words, the lift 143 can have any structure so long as it has an extendable structure to adjust the height of the frame 141.

As such, the lift 143 can be embodied in various ways. For example, a working cylinder which is extended or retracted using working fluid such as air or oil may be used as the lift 143. As needed, any known technique can also be used so long as it can adjust the height of the frame 141.

Further, an elastic member 144 may be installed between the frame 141 and the base 142 so as to apply external force the frame 141 upwards.

As shown in FIG. 4, the elastic member 144 pushes the second bundle transfer part 120 upwards so that, even when the thickness of the bill bundle 10 is gradually reduced as an upper portion of the bill bundle 10 is moved towards the semi-separation unit 200, the first belt 112 can come into contact with the upper surface of the bill bundle 10 in succession.

The first bundle transfer part 110 further includes a guide 150 which forms a space d between the first bundle transfer part 110 and the semi-separation unit 200. Among bills of the upper portion of the bill bundle 10 that is moved by the first belt 112, only a preset number of bills can pass through the space d defined between a lower surface of the guide 150 and the semi-separation unit 200.

Here, the space d functions to prevent deterioration in the performance of separating bills in the sheet-by-sheet separation unit 300 or a subsequent path when an excessive amount of bills are supplied thereto at a time during a process of transferring the bill bundle 10. In this embodiment, the space d allows only a predetermined few number of bills, for example, two or three bills, to pass therethrough so that the performance of separating the bills sheet-by-sheet can be enhanced.

For instance, in the case where the apparatus is set such that only two or three bills pass through the space d at a time, even if five bills that have been located in the upper portion of the bill bundle 10 are transferred by the first belt 112, only a few number of bills, that is, two or three bills, pass through the space d defined between the guide 150 and the semi-separation unit 200. Therefore, the performance of separating bills sheet-by-sheet in the subsequent process can be enhanced.

The semi-separation unit 200 is disposed at the rear end of the bundle transfer unit 100. As stated above, the semi-separation unit 200 can limit the number of bills transferred thereto so that only a preset number of bills separated from the bill bundle 10 can pass through the semi-separation unit 200.

The semi-separation unit 200 includes a separation roller 210 which defines the space d between it and the lower surface of the bundle transfer unit 100, and a bill press 220 which is configured so as to be movable upwards or downwards and provided with the semi-separation roller 210 on a portion of an upper end thereof. The semi-separation unit 200 is configured such that, among bills disposed on the upper portion of the bill bundle 10 that is moved by the first belt 112, only a preset number of bills can pass through the space d defined between the semi-separation roller 210 and the lower surface of the bundle transfer unit 100.

In the case where the guide 150 is provided in the bundle transfer unit 100, the lower surface of the bundle transfer unit 100 can be the lower surface of the guide 150. In this case, the semi-separation roller 210 of the semi-separation unit 200 defines the space d between it and the lower surface of the guide 150.

Furthermore, the semi-separation roller 210 which has a one-way rotation mechanism is provided at a predetermined position on the upper end of the bill press 220. The bill press 220 is moved upwards or downwards by a separate lift means (not shown) and thus adjusted in height. The adjustment in height of the bill press 220 can be easily embodied by a known technique. Having the same structure as the lift means 140 of the second bundle transfer part 120 that has been illustrated above, a lift means may be used. The kind of the lift means can be selected by a manufacturer as needed.

Regardless of the thickness of the bill bundle 10, the bill press 220 moves to a preset location and is on standby. Several bills that have been in the upper end of the bill bundle 10 are transferred by the operation of the first bundle transfer part 110 to the semi-separation unit 200 through the space d. After the transfer of the several bills has been completed, the operation of the first bundle transfer part 110 is interrupted. Subsequently, when separation of the bills in the semi-separation unit 200 has been completed, the first bundle transfer part 110 is operated again so that several bills are transferred to the semi-separation unit 200.

The semi-separation roller 210 comprises a one-way roller which is configured in such a way that when a preset number of bills is moved in the bill receiving direction, the roller is in a stationary state without rotation, and when the deposit is canceled, it is rotated to move bills in a direction opposite to the bill receiving direction.

The one-way roller is a roller which is configured to be rotated only in one direction. The construction and structure of the one-way roller is a known technique, so detailed explanation thereof is deemed unnecessary.

The reason why the semi-separation roller 210 is configured to be not rotated when several bills are moved in the bill receiving direction is because of the fact that if the semi-separation roller 210 is configured to be also rotated when the bills are moved in the bill receiving direction, even if the space d is set such that only a preset number of bills can pass through the space d, a more number of bills than the preset number of bills may be passed through the space d by the rotation of the semi-separation roller 210. However, in the case where the semi-separation roller 210 is configured to be not rotated, even if a number of bills more than the number of bills that can pass through the space d is provided from the bundle transfer unit 100, bills other than the preset number of bills are blocked by the guide 150 and the semi-separation roller 210 without passing through the space d.

Meanwhile, not only bills to be deposited but bills that are moved in the direction opposite to the bill receiving direction when the deposit is canceled can also pass through the semi-separation unit 200. When bills that are moved in the direction opposite to the bill receiving direction pass through the semi-separation unit 200, the semi-separation roller 210 is rotated so that a number of bills more than the preset number of bills can pass through the space d.

The bills that are moved in the direction opposite to the bill receiving direction are transferred by the bundle transfer unit 100 after passing through the semi-separation roller 210. In this case, even when a number of bills more than the preset number of bills are transferred from the semi-separation roller 210 to the bundle transfer unit 100, no problem is caused in the bundle transfer unit 100.

Meanwhile, the sheet-by-sheet separation unit 300 is disposed behind the semi-separation unit 200 so as to receive bills from the semi-separation unit 200 and transfer the bills sheet-by-sheet.

Figure 6:
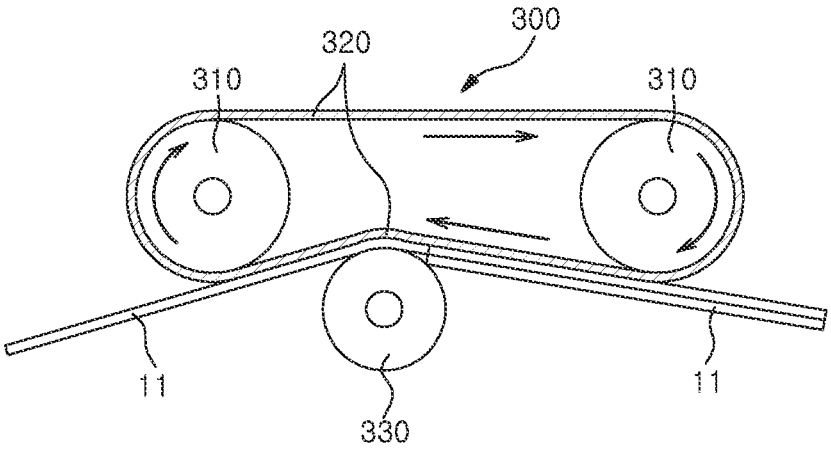
FIG. 6 is a view illustrating the construction of a sheet-by-sheet separation unit of the cash and check receiving apparatus in accordance with the first embodiment of the present invention.

As shown in FIG. 6, the sheet-by-sheet separation unit 300 includes main rollers 310, a belt 320 and a tension roller 330.

The main rollers 310 are rotatably provided in respective opposite ends of the sheet-by-sheet separation unit 300. The belt 320 connects the main rollers 310 to each other to form an endless track structure and moves in response to rotation of the main rollers 310.

The tension roller 330 is disposed between the main rollers 310 and applies a predetermined tension to a lower portion of the belt 320 so that the lower portion of the belt 320 forms a curved shape rather than having a linear shape.

In detail, the tension roller 330 pushes the lower portion of the belt 320 with a predetermined force such that only a single bill is allowed to pass through space between the tension roller 330 and the belt 320. Here, the tension roller 330 remains in a stationary state without rotating.

Therefore, when no bill is supplied to the sheet-by-sheet separation unit 300, the belt 320 merely slides on the tension roller 330 which is in the stationary state. When a bill is supplied to the sheet-by-sheet separation unit 300, the belt 320 is pushed because of available tension of the belt 320, and the bill passes between the tension roller 330 and the belt 320.

That is, the tension roller 330 pushes the belt 320 such that the belt 320 has available tension to allow only a bill to pass through the tension roller 330.

As shown in FIG. 6, when two or three bills 11 which are piled on top of one another are supplied from the semi-separation unit 200 to the sheet-by-sheet separation unit 300, only a bill 11 that is disposed at the uppermost position of the two or three of bills 11 is moved along the belt 320 through the space between the belt 320 and the tension roller 330, because only belt 320 is moved but the tension roller 330 is not rotated. The rest of the bills 11 are blocked by the tension roller 330 and are on standby.

After the single bill 11 completely passes through the space between the belt 320 and the tension roller 330, among the bills 11 that have been on standby, the uppermost bill 11 passes through the space between the belt 320 and the tension roller 330. In this way, bills 11 passes sheet-by-sheet through the sheet-by-sheet separation unit 300.

Hereinafter, an apparatus for receiving cash and check in accordance with a second embodiment of the present invention will be described in detail with reference to FIGS. 7 through 9C.

Based on the above-described construction of the first embodiment, the second embodiment in accordance with the present invention further includes an alignment unit 160.

When the bill bundle 10 which has been moved by the bundle transfer unit 100 reaches the preset reference position, the alignment unit 160 applies a predetermined external force to the bill bundle 10 so as to align the bills of the bill bundle 10 with each other relative to the vertical direction.

In this embodiment, because the bill bundle 10 may include several kinds of cash and checks having different sizes, bills of the bill bundle 10 which are piled on top of one another are uneven with respect to the vertical direction rather than being aligned with each other.

As such, if the piled bills of the bill bundle 10 are uneven with respect to the vertical direction rather than being aligned, it may be difficult to separate bills from the bill bundle 10 by a preset number in the semi-separation unit 200, and it may not easy to accurately recognize the cash and checks because the locations of the sheets of cash and checks are different from each other.

Particularly, given the fact that a magnetic character string is printed with special magnetic ink at a predetermined position on checks, if several sheets of checks having different sizes (for example, personal checks and business checks may have different sizes from each other) are not aligned with each other, it may be difficult to recognize the magnetic character string.

Therefore, in this embodiment, the alignment unit 160 aligns edges of misaligned bills having different sizes with a first side of the bill bundle 10 with respect to the vertical direction, thus facilitating the operation of recognizing cash and checks. Here, the first side of the bill bundle may refer to one edge of the bill bundle. In the case of checks, the first side of the bill bundle may refer to a side at which the magnetic character string is located.

Figure 7:
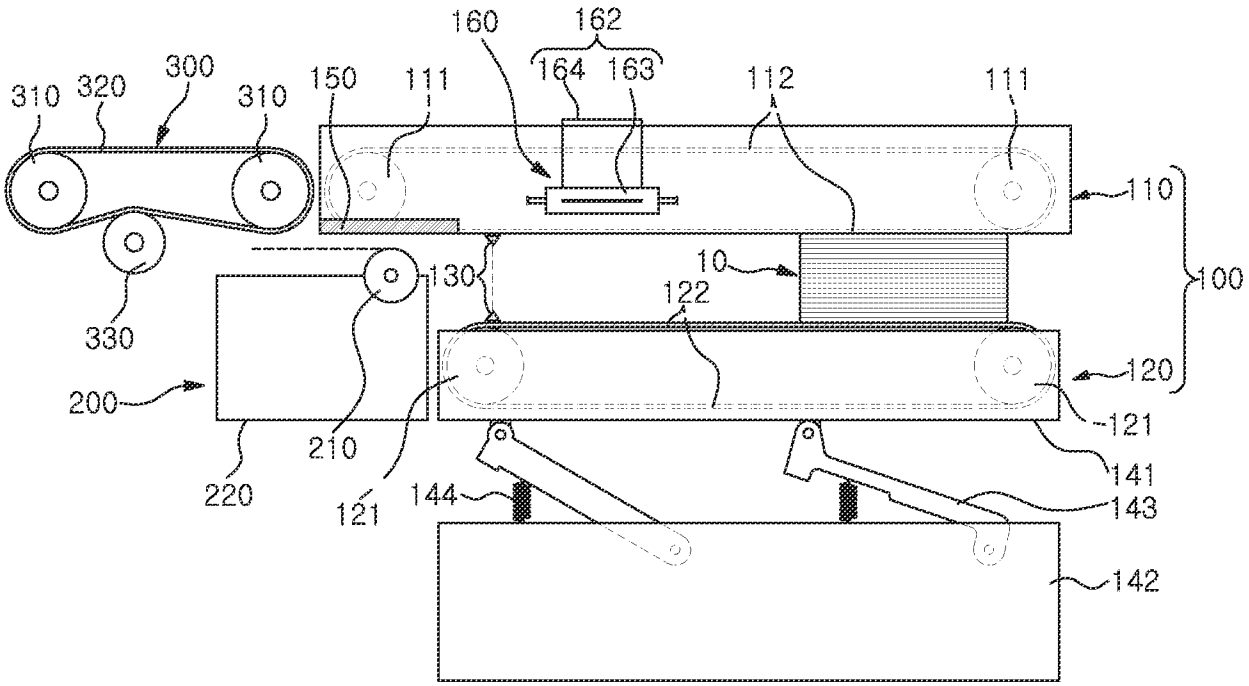
FIG. 7 is a view an apparatus for receiving cash and check in accordance with a second embodiment of the present invention.
Figure 9A:
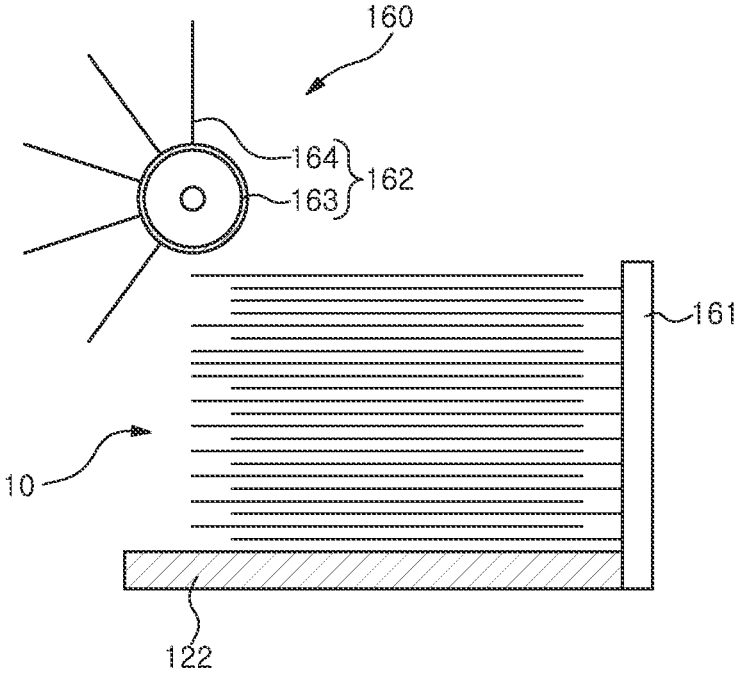
FIGS. 9A through 9C are views shown from the direction designated by arrow "A" of FIG. 8 to illustrate the construction and operation of the alignment unit in accordance with the second embodiment of the present invention.

As shown in FIG. 7, the alignment unit 160 is provided on the first bundle transfer part 110. As shown in FIGS. 9A through 10, the alignment unit 160 includes a vertical member 161 and a sheet roller unit 162.

The vertical member 161 is placed upright adjacent to the first side of the bill bundle 10 and functions as a reference surface for alignment of the bill bundle 10. Preferably, a side of the vertical member 161 that faces the bill bundle 10 is a planar surface.

The sheet roller unit 162 is rotatably provided above the bill bundle 10. The sheet roller unit 162 rotates and applies external force to the bill bundle 10 to move at least one bill in a lateral direction, thus bringing the first side of the bill bundle 10 into close contact with the vertical member 161.

As shown in FIG. 7, the sheet roller unit 162 is installed in the first bundle transfer part 110. In this embodiment, to prevent the sheet roller unit 162 from interfering with the first belt 112 of the first bundle transfer part 110, the sheet roller unit 162 is disposed between the upper and lower portion of the first belt 112 that are spaced apart from each other by a predetermined distance.

Figure 9B:
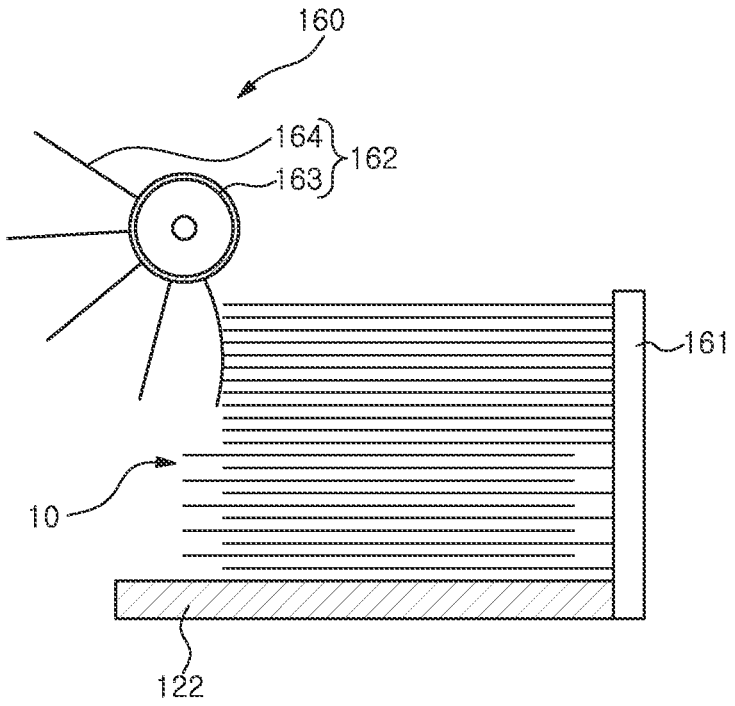
Figure 9C:
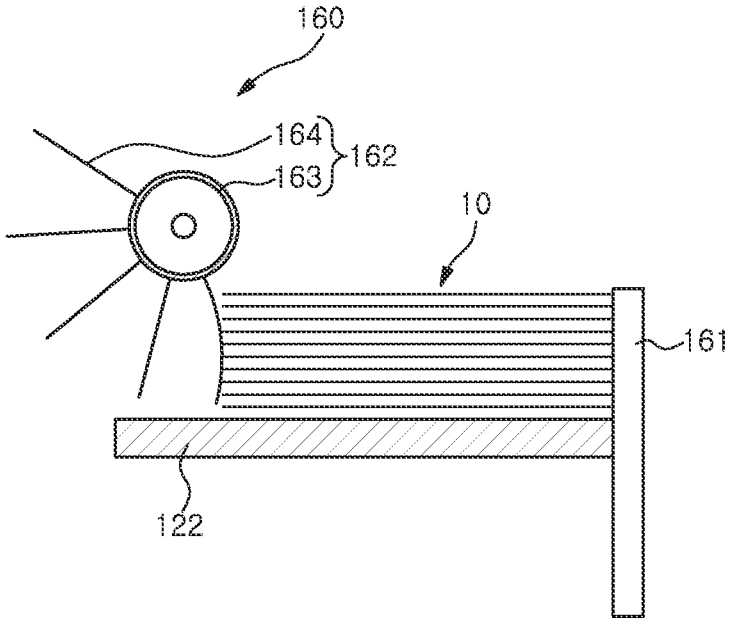
Figure 10:
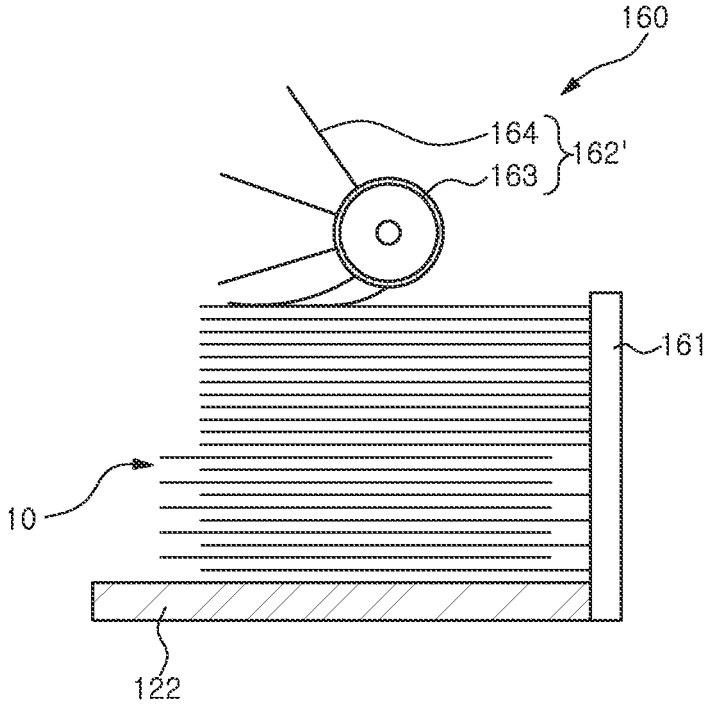
FIG. 10 is a view illustrating the alignment unit having a sheet roller unit disposed at a different position from that of FIGS. 9A through 9C.

As shown in FIGS. 9A through 9C, the sheet roller unit 162 is disposed at a predetermined position such that it can strike a second side of the bill bundle 10 to bring the second side of the bill bundle 10 into close contact with the vertical member 161.

In this embodiment, when the bill bundle 10 is transferred both by the first belt 112 disposed above the bill bundle 10 and by the second belt 122 disposed below the bill bundle 10 and reaches the preset reference position (that is, to the position at which the bundle sensor 130 is disposed), the sheet roller unit 162 begins to rotate and strikes a second side of the bill bundle 10 several times so that the first side of the bill bundle 10 can come into close contact with the vertical member 161. Thereby, first edges of the bills that correspond to the first side of the bill bundle 10 are brought into close contact with the inner surface of the vertical member 161, whereby the first edges of the bills can be aligned with each other.

In another embodiment of the alignment unit, as shown in FIG. 10, a sheet roller unit 162' is disposed at a predetermined position such that it comes into contact with the upper portion of the bill bundle 10 and moves the bills using frictional force in the lateral direction so that the first side of the bill bundle 10 is brought into close contact with the vertical member 161.

As such, while the bill bundle 10 is aligned at the first side thereof, the upper portion of the bill bundle 10 is moved towards the semi-separation unit 200 by the first bundle transfer part 110 that is being continuously operated. Here, the second bundle transfer part 120 is in the interrupted state, as described above.

That is, as shown in FIG. 2, before the bill bundle 10 supplied into the bundle transfer unit 100 reaches the preset reference position, both the first bundle transfer part 110 and the second bundle transfer part 120 are operated such that the bill bundle 10 can be moved towards the semi-separation unit 200 (in the bill receiving direction). On the other hand, the sheet roller unit 162 is in the interrupted state.

Figure 8:
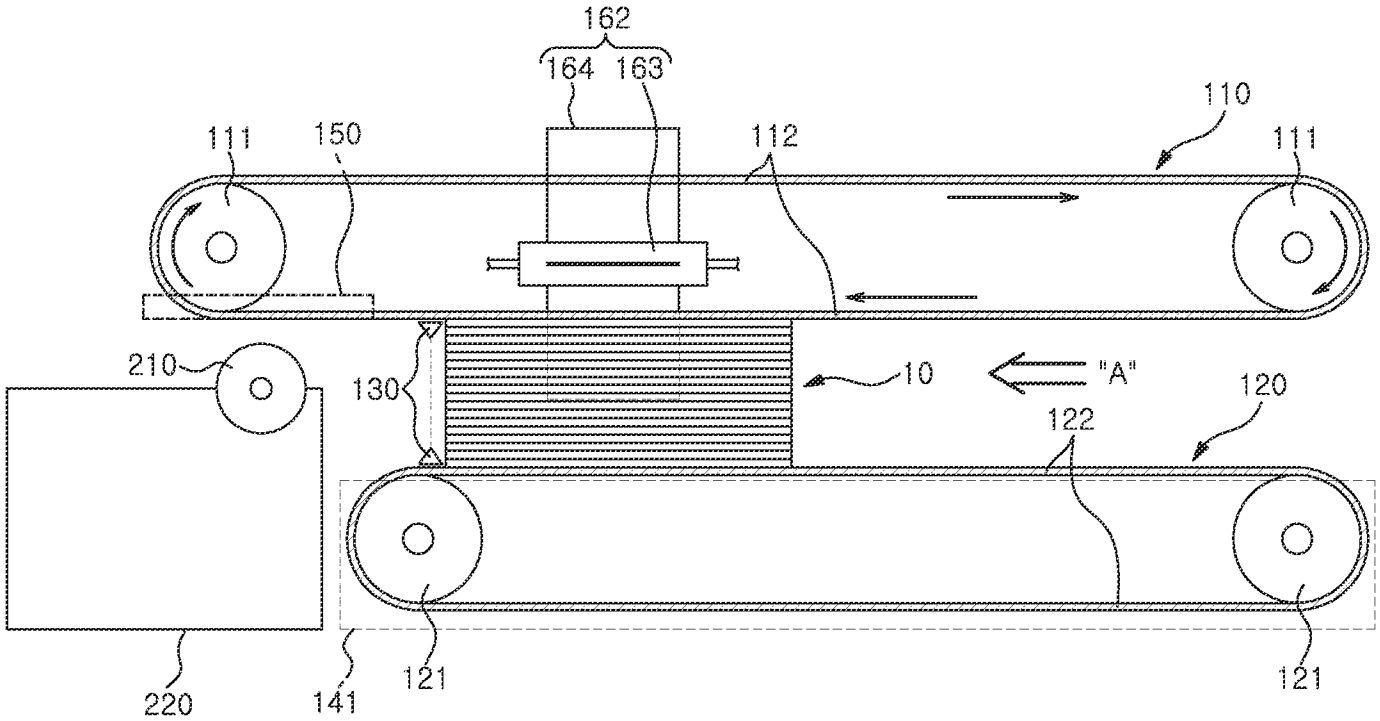
FIG. 8 is a view showing the construction and operation of a bundle transfer unit and an alignment unit of the cash and check receiving apparatus in accordance with the second embodiment of the present invention.

In this state, as shown in FIG. 8, when the bill bundle 10 reaches the preset reference position, the bundle sensor 130 senses the bill bundle 10 and temporarily pauses the first bundle transfer part 110 and the second bundle transfer part 120. When the first bundle transfer part 110 and the second bundle transfer part 120 are temporarily interrupted, the sheet roller unit 162 or 162' of the alignment unit 160 is operated so as to align bills disposed in the upper portion of the bill bundle 10 with each other on the vertical member 161.

After the sheet roller unit 162 or 162' is operated a preset number of times or for a preset time of period, the first bundle transfer part 110 begins to be operated again while the second bundle transfer part 120 is maintained in the interrupted state. Thereby, the upper portion of the bill bundle that has been aligned is moved to the semi-separation unit 200.

In this embodiment, although the alignment unit 160 has been illustrated as being operated while both the first bundle transfer part 110 and the second bundle transfer part 120 are interrupted, the spirit of the present invention is not limited to this structure.

For instance, the present invention may be configured such that, when the bundle sensor 130 senses that the bill bundle 10 reaches the preset reference position, the first bundle transfer part 110 is continuously operated in the same direction but the operation of the second bundle transfer part 120 is interrupted, and upon the interruption of the second bundle transfer part 120 the sheet roller unit 162 or 162' of the alignment unit 160 begins to be operated to align the bill bundle 10. While the bill bundle 10 is aligned, an upper portion of the bundle 10 that has been aligned is moved to the semi-separation unit 200 by the first bundle transfer part 110.

Furthermore, in this embodiment, although the alignment unit 160 has been illustrated as being operated when the bill bundle 10 is located at the rear end of the bundle transfer unit 100 at which the bundle sensor 130 is installed, the spirit of the present invention is not limited to this structure. For example, the alignment unit 160 may be operated while the bill bundle 10 is moved, e.g., when the bill bundle 10 is located at the position of FIG. 2. As stated above, the alignment unit 160 may be operated while at least one of the first bundle transfer part 110 and the second bundle transfer part 120 is operated or interrupted.

Meanwhile, even if the sheet roller unit 162 or 162' which is disposed above the bill bundle 10 moves only bills that are in the upper portion of the bill bundle 10 to align the bills rather than moving all of the bills of the bill bundle 10 at the same time, because bills that have been aligned are successively transferred to the semi-separation unit 200 by the first bundle transfer part 110 and bills that are still not aligned are moved upwards by means of the elastic member 144 of the second bundle transfer part 120, the alignment of the bills of the bill bundle 10 can be gradually performed.

As shown in FIGS. 9A through 9C, the sheet roller unit 162, 162' includes a roller body 163 and elastic sheets 164.

The roller body 163 is provided so as to be rotatable around a rotating shaft. The elastic sheets 164 are arranged in a circumferential direction on a predetermined partial section of an outer circumferential surface of the roller body 163. Each elastic sheet 164 radially protrudes a predetermined length from the outer circumferential surface of the roller body 163. When the roller body 163 rotates, the elastic sheets 164 rotate along with the roller body 163 and, as shown in FIG. 9B, strike the bill bundle 10. The elastic sheets 164 of the sheet roller unit 162' which is disposed in the manner illustrated in FIG. 10 come into contact with an upper portion of the bill bundle 10 and moves bills disposed in the upper portion of the bill bundle 10 in the lateral direction using frictional force so that the first side of the bill bundle 10 comes into close contact with the vertical member 161.

The elastic sheets 164 are circumferentially arranged on only a predetermined partial section of the outer circumferential surface of the roller body 163 rather than being provided on the entirety of the outer circumferential surface of the roller body 163. The reason why the elastic sheets 164 are provided on only the partial section is to reduce the load when transferring (returning) the bill bundle 10. For this, the angle of rotation of the sheet roller unit 162 is controlled in such a way that when the bill bundle 10 is transferred, a portion of the sheet roller unit 162, on which the elastic sheet 164 is not provided, faces the bill bundle 10.

In this embodiment, although the elastic sheets 164 are illustrated as being provided on a partial section of the roller body 163 that is less than a half of the outer circumferential surface of the roller body 163 and being spaced apart from each other at regular intervals, the section in which the elastic sheets 164 are provided can be appropriately adjusted as needed.

As described above, in an apparatus for receiving cash and check in accordance with the present invention, cash and checks which are provided in a bundle form can be received and handled at the same time. Furthermore, the apparatus is provided with a semi-separation unit so that, even if a lot of bills are inserted into the apparatus, the operation of separating bills can be reliably conducted.

In addition, during a process of receiving cash and checks having different sizes at the same time, an alignment unit can rapidly and simply align the cash and checks with each other. Thereby, the performance of separating bills and the ability to recognize the bills can be enhanced.

While the invention has been shown and described with respect to the preferred embodiments, it will be understood by those skilled in the art that various changes and modifications may be made without departing from the spirit and scope of the invention as defined in the following claims.

What is claimed is:

1. An apparatus for receiving cash and checks that is able to receive and process a bill bundle input thereinto, the bill bundle including at least one of cash and checks, the apparatus comprising:

a bundle transfer unit for transferring the bill bundle input into the apparatus, the bundle transfer unit being provided above and below the bill bundle and extending along a path for transferring the bill bundle;

a semi-separation unit installed behind a rear end of the bundle transfer unit, the semi-separation unit limiting the number of bills to be transferred in such a way that only a preset number of bills separated from the bill bundle is allowed to pass through the semi-separation unit; and a sheet-by-sheet separation unit installed behind a rear end of the semi-separation unit, the sheet-by-sheet separation unit separating bills transferred from the semi-separation unit from each other sheet-by-sheet;

wherein the semi-separation unit comprises:

a semi-separation roller provided such that a space is defined between the semi-separation roller and a lower surface of the bundle transfer unit, the space allowing the preset number of bills to pass therethrough; and a bill press provided so as to be movable upwards or downwards, with the semi-separation roller provided at a predetermined position on an upper end of the bill press;

the semi-separation roller comprises a one-way roller configured such that when bills are transferred in a bill receiving direction, the one-way roller is not rotated, and only when the bills are moved in a direction opposite to the bill receiving direction, the one-way roller is rotated.

2. The apparatus of claim 1, wherein the bundle transfer unit comprises:

a first bundle transfer part disposed above the bill bundle input into the apparatus, the first bundle transfer part coming into contact with an upper surface of the bill bundle; and a second bundle transfer part disposed below the bill bundle input into the apparatus, the second bundle transfer part coming into contact with a lower surface of the bill bundle.

3. The apparatus of claim 2, wherein the first bundle transfer part extends rearwards longer than the second bundle transfer part.

4. The apparatus of claim 3, wherein the first bundle transfer part comprises a guide with a space defined between the guide and the semi-separation unit, the space being set such that only the preset number of bills can pass through the space.

5. The apparatus of claim 3, wherein before the bill bundle input into the apparatus reaches a preset reference position, both the first bundle transfer part and the second bundle transfer part are operated such that the bill bundle is moved towards the semi-separation unit, and when the bill bundle reaches the preset reference position, the first bundle transfer part is continuously operated, and the second bundle transfer part is interrupted.

6. The apparatus of claim 5, wherein a bundle sensor is provided at the reference position so as to sense whether the bill bundle reaches the reference position.

7. The apparatus of claim 2, wherein the second bundle transfer part comprises a lift means for moving the second bundle transfer part in a vertical direction so that a space corresponding to a thickness of the bill bundle is formed between the first bundle transfer part and the second bundle transfer part.

8. The apparatus of claim 7, wherein the lift means comprises:

a frame on which bundle transfer rollers and a belt are installed;

a base provided below the frame at a position spaced apart from the frame by a predetermined distance; and a lift for lifting the frame from the base.

9. The apparatus of claim 8, wherein an elastic member is installed between the frame and the base, the elastic member applying external force to the frame upwards.

10. The apparatus of claim 1, wherein the sheet-by-sheet separation unit comprises:

main rollers rotatably provided in respective opposite ends of the sheet-by-sheet separation unit;

a belt connecting the main rollers to each other to form an endless track structure; and a tension roller disposed between the main rollers, the tension roller applying tensile force to the belt so that only a single bill is able to pass between the belt and the tension roller.

11. The apparatus of claim 10, wherein the tension roller is stationary without rotating.

12. The apparatus of claim 10, wherein the tension roller applies pressure to the belt so that a lower portion of the belt forms a curved shape.

13. The apparatus of claim 1, further comprising an alignment unit applying external force to the bill bundle that has reached the preset reference position by the bundle transfer unit, whereby a first side of the bill bundle is aligned with respect to a vertical direction.

14. The apparatus of claim 13, wherein the alignment unit comprises:

a vertical member placed upwards adjacent to the first side of the bill bundle; and a sheet roller unit provided above the bill bundle so as to be rotatable, the sheet roller unit rotating and applying external force to the bill bundle to move at least one bill of the bill bundle in a lateral direction, whereby the first side of the bill bundle comes into close contact with the vertical member.

15. The apparatus of claim 14, wherein the sheet roller unit strikes a second side of the bill bundle such that the first side of the bill bundle comes into close contact with the vertical member.

16. The apparatus of claim 14, wherein the sheet roller unit makes contact with an upper portion of the bill bundle and moves the bills in the lateral direction using friction force such that the first side of the bill bundle comes into close contact with the vertical member.

17. The apparatus of claim 15, wherein the sheet roller unit comprises:

a roller body provided so as to be rotatable around a rotating shaft; and elastic sheets arranged in a circumferential direction on a predetermined partial section of an outer circumferential surface of the roller body, each of the elastic sheets radially protruding a predetermined length from the outer circumferential surface of the roller body so that when the roller body rotates, the elastic sheets strike the bill bundle.

18. The apparatus of claim 17, wherein the elastic sheets are spaced apart from each other at regular intervals and provided on a partial section of the roller body that is less than a half of the outer circumferential surface of the roller body.

* * * * *